United States Patent [19]

Hill

[11] Patent Number: 4,519,520

[45] Date of Patent: May 28, 1985

[54] VESSEL LID ATTACHMENT

[76] Inventor: Charles A. Hill, 4641 Mt. Forde Ave., San Diego, Calif. 92117

[21] Appl. No.: 642,096

[22] Filed: Aug. 20, 1984

[51] Int. Cl.[3] ..... B65D 43/26

[52] U.S. Cl. ..... 220/263; 220/85 CH; 220/95

[58] Field of Search ..... 220/85 CH, 263, 337, 220/95; 126/25 R; 16/348, 360, 373, 386

[56] References Cited

U.S. PATENT DOCUMENTS

| | | | |
|---|---|---|---|
| 1,260,771 | 3/1918 | Hartman | 220/263 |
| 1,264,475 | 4/1918 | Baker | 220/263 |
| 2,106,892 | 2/1938 | Kamenstein | 220/263 |
| 4,390,002 | 6/1983 | Daily, III | 220/85 CH |

*Primary Examiner*—George T. Hall

*Attorney, Agent, or Firm*—Charmasson & Holz

[57] ABSTRACT

For vessels such as drinking cups formed from a metal stamping, having a rim formed by crimping the vessel lip around a length of wire, a U-shaped loop of which protrudes from two slots in said rim and is bent to form a handle, a new vessel lid attachment is provided which includes a hinge pin fashioned from a second length of wire which connects both sides of said U-shaped loop near the rim of said vessel, a hinge formed by an extension of said lid, having two parallel tabs which are slotted to slide over said hinge pin, said hinge also serving as a thumb operated lever for lifting said lid.

3 Claims, 3 Drawing Figures

VESSEL LID ATTACHMENT

FIELD OF THE INVENTION

The present invention relates to lid attachment devices for stamped vessels having a rim formed by crimping the vessel lip around a length of wire.

BACKGROUND OF THE INVENTION

A vessel stamped from sheet metal which has a handle formed from a U-shaped loop in the length of wire which is crimped into its rim is a model of simplicity. Heretofore, devices for connecting lids to such vessels have been relatively complex and expensive. The present invention constitutes a ultra-simple, inexpensive means for connecting lids to such vessels.

SUMMARY OF THE INVENTION

The present invention is intended to minimize the number of separate parts necessary to attach a lid to a vessel of the type described above. The vessel lid attachment disclosed herein requires a specially designed lid which incorporates the hinge in a single stamping or injection molding. The hinge comprises two parallel slotted tabs which are integrally connected to a rectangular lid extension which is angled up at the edge of the lid to form a lever. The slotted tabs slide over a hinge pin formed from a length of wire which connects the two sides of the U-shaped wire vessel handle near the rim of said vessel. In order to anchor said hinge pin, one or both ends may be crimped beneath the tab which is formed by the slots through which the handle wires protrude from the rim of said vessel. The lid may be lifted by pressing down on said rectangular lid extension, which functions as as lever while said hinge pin functions as its fulcrum.

DESCRIPTION OF THE PREFERRED EMBODIMENT OF THE INVENTION

Figure 1:
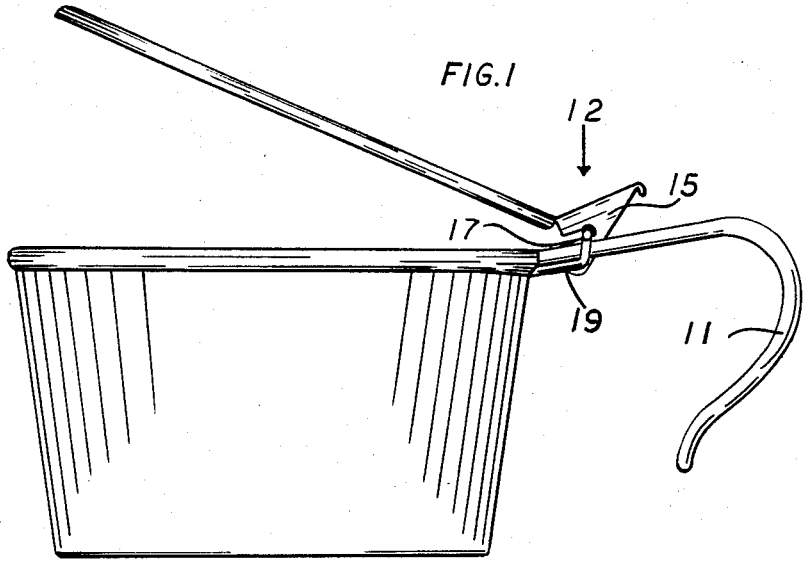
FIG. 1 shows an elevational side view of a lid and cup attached by means of the instant invention.
Figure 2:
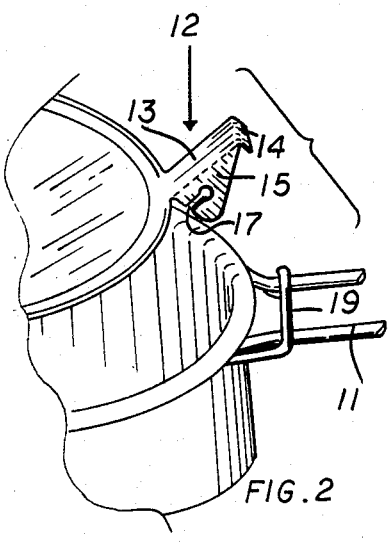
FIG. 2 shows a partial perspective view of said lid and said cup, with the lid detached from the cup in order to more fully show the details of the lid attachment.
Figure 3:
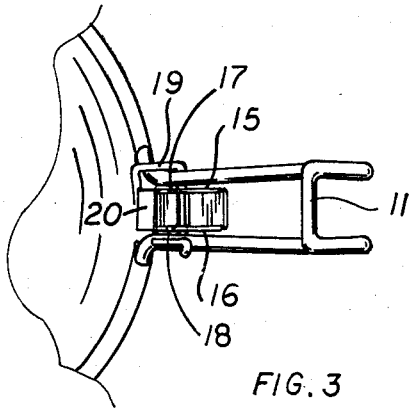
FIG. 3 shows a partial bottom plan view of said lid attached to said cup by means of the instant invention.

The vessel lid attachment disclosed herein is intended for use on a vessel such as the drinking cup of FIG. 1, which is formed from sheet metal and incorporates a first length of wire 11 as both a rim reinforcement and a handle. Said vessel lid attachment requires a specially-designed lid which incorporates a hinge-lever 12 on its periphery, formed simultaneously with said lid in a single stamping. Said hinge-lever 12 is formed from four interconnected planes of sheet metal: The first plane is a rectangular area 13, connected at one end to said lid via a bend of approximately 45 degrees from the level of said lid; the second is a much smaller, nearly rectangular tab 14 which is connected to the other end of rectangular area 13 and is bent down to form a right angle with the latter so as to eliminate a sharp edge; the third and fourth planes are the approximately triangular tabs 15 and 16, respectively having slots 17 and 18, said triangular tabs being connected to the side edges of said rectangular area 13 and bent down to form right angles with the latter. Said hinge-lever 12 is symmetrical about a plane passing perpendicularly through a line which divides said rectangular area 13 lengthwise into two equal, smaller rectangles.

Slots 17 and 18 fit snugly over hinge pin 19, which is fashioned from a second length of wire of somewhat smaller gage than said first length of wire 11 and interconnects both sides of the handle formed by the first length of wire 11. One end of hinge pin 19 is anchored beneath vessel rim tab 20.

Hinge-lever 12 forms a raised lever when said lid rests on the rim of the vessel. By pressing down on hinge-lever 12, hinge pin 19 acts a fulcrum and lid is raised.

What is claimed is:

1. An improved lid attachment of the type used to attach a lid to a vessel formed from a metal stamping having a rim crimped around a length of wire, a bent U-shaped loop of which protrudes from two slots in the rim to form a handle, wherein the improvement comprises:

a hinge pin formed from a second length of wire which connects both sides of said wire handle near said rim;

a hinge-lever integral with said lid having two parallel slotted tabs which slide over said hinge pin;

2. The device claimed in claim 1 wherein said second length of wire is crimped beneath the tab formed by said two slots in vessel rim.

3. The device claimed in claim 2 wherein said hinge forms a raised lever when said lid rests on the rim of said vessel, whereby said lid may be raised, using said hinge pin as a fulcrum, by pressing down on said lever.

* * * * *